US012011029B2

(12) United States Patent
Sartoni et al.

(10) Patent No.: US 12,011,029 B2
(45) Date of Patent: Jun. 18, 2024

(54) DEVICE AND METHOD FOR MOVING TUBULAR BODIES

(71) Applicant: G.D S.p.A., Bologna (IT)

(72) Inventors: Massimo Sartoni, Bologna (IT); Fausto Mengoli, Sasso Marconi (IT)

(73) Assignee: G.D S.P.A., Bologna (IT)

( * ) Notice: Subject to any disclaimer, the term of this patent is extended or adjusted under 35 U.S.C. 154(b) by 9 days.

(21) Appl. No.: 15/768,280

(22) PCT Filed: Oct. 12, 2016

(86) PCT No.: PCT/IB2016/056090

§ 371 (c)(1),
(2) Date: Apr. 13, 2018

(87) PCT Pub. No.: WO2017/068462

PCT Pub. Date: Apr. 27, 2017

(65) Prior Publication Data

US 2018/0279669 A1 Oct. 4, 2018

(30) Foreign Application Priority Data

Oct. 19, 2015 (IT) ..... 102015000062964

(51) Int. Cl.
*A24C 5/32* (2006.01)
*A24D 3/02* (2006.01)

(52) U.S. Cl.
CPC ..... *A24C 5/327* (2013.01); *A24C 5/323* (2013.01); *A24D 3/0291* (2013.01); *A24D 3/0254* (2013.01)

(58) Field of Classification Search
CPC ..... A24C 5/327; A24C 5/323
(Continued)

(56) References Cited

U.S. PATENT DOCUMENTS 2,808,105 A * 10/1957 Krohne ..... A24D 3/0254 83/161
2,988,402 A 6/1961 Policansky
(Continued)

FOREIGN PATENT DOCUMENTS

CA 817682 A 7/1969
DE 2007615 A1 9/1971
(Continued)

OTHER PUBLICATIONS

Machine Translation of DE 2007615 (Year: 1971).*
(Continued)

*Primary Examiner* — Russell E Sparks
(74) *Attorney, Agent, or Firm* — SHUTTLEWORTH & INGERSOLL, PLC; Timothy J. Klíma

(57) ABSTRACT

A device for moving tubular bodies, includes a conveyor belt for feeding a plurality of tubular pieces, each extending along a respective axis of extension, in such a way as to provide a succession of groups of tubular pieces where each group is defined by a predetermined number of tubular pieces positioned in succession along the respective axis of extension and transversely offset therefrom. The device includes at least one housing for containing at least one tubular piece inside of which an air cushion is produced by which the tubular piece is transferred translationally outside the housing along its respective axis of extension.

12 Claims, 6 Drawing Sheets

(58) Field of Classification Search
USPC ..... 131/46
See application file for complete search history.

(56) References Cited

U.S. PATENT DOCUMENTS

| | | | | | |
|---|---|---|---|---|---|
| 3,062,588 | A | * | 11/1962 | Rakowicz | A24C 5/323 406/32 |
| 3,393,591 | A | | 7/1968 | Rakawicz | |
| 3,535,003 | A | * | 10/1970 | Ludszeweit | B65G 51/02 406/67 |
| 3,724,339 | A | * | 4/1973 | Metzinger | A24C 5/474 493/4 |
| 3,868,013 | A | * | 2/1975 | Brackmann | A24C 5/478 198/392 |
| 3,943,752 | A | * | 3/1976 | Doerman | G01M 3/02 73/41 |
| 3,978,969 | A | * | 9/1976 | Williams | A24C 5/478 198/461.2 |
| 4,290,518 | A | * | 9/1981 | Dyett | A24C 5/478 198/450 |
| 4,943,272 | A | | 7/1990 | Hirose et al. | |

FOREIGN PATENT DOCUMENTS

| | | | | | |
|---|---|---|---|---|---|
| DE | 2513663 | A1 | | 10/1976 | |
| EP | 2708149 | A2 | | 3/2014 | |
| GB | 1542883 | A | | 3/1979 | |
| GB | 2169257 | A | * | 7/1986 | A24C 5/35 |
| GB | 2169257 | A | | 7/1986 | |
| WO | 2014188305 | A1 | | 11/2014 | |

OTHER PUBLICATIONS

Definition of Jet, Merriam Webster Dictionary, https://www.merriam-webster.com/dictionary/jet (Year: 2021).*
International Search Report and Written Opinion dated Feb. 6, 2017 for counterpart PCT Application No. PCT/IB2016/056090.
Brazilian Office Action issued Dec. 10, 2016 for counterpart Brazilian Patent Application No. BR112018007389.0.
Japanese Office Action dated Sep. 7, 2020 from counterpart Japaense Patent Application No. 2018-519905.
United Arab Emirates Office Action dated Jul. 12, 2021 from counterpart United Arab Emirates Patent No. P6000525/2018.

* cited by examiner

DEVICE AND METHOD FOR MOVING TUBULAR BODIES

This application is the National Phase of International Application PCT/IB2016/056090 filed Oct. 12, 2016 which designated the U.S.

This application claims priority to Italian Patent Application No. 102015000062964 filed Oct. 19, 2015.

TECHNICAL FIELD

This invention relates to a device and a method for moving tubular bodies, made preferably of paper, paperboard, cardboard or plastic material.

Preferably, such tubular bodies define a component of a smokable article, for example a cigarette, and in particular, such tubular components are assembled to portions of a cigarette filter to make composite filters.

This invention is thus applicable in particular in the tobacco industry and, more specifically, in the construction of machines for making composite filters (filter makers or combiners) or cigarette holders.

BACKGROUND ART

Known in the prior art are systems for moving filters or pieces of "solid" filter, that is to say, cylindrical bodies made of filter material and thus defining a resistance to axial fluid flow.

In light of this, known devices can be broadly divided into two types, both based on the use of a pneumatic action, in one case as an active component in the movement of the filter pieces and, in the other case, as a retaining component.

In effect, a first prior art technique involves cutting the filter into a plurality of coaxial pieces, offsetting them by means of an offsetting drum and then applying suction to the filter pieces along the axial direction in such a way as to place them side by side to form an ordered sequence.

Alternatively, the pieces are offset and positioned on suction plates which hold each piece and move it translationally.

Disadvantageously, such methods cannot be used in the production of filters or cigarette holders and, more specifically, for the movement of the tubular elements constituting the above mentioned tubular bodies.

In effect, the low resistance offered by the thin side walls of the tubular filter pieces would cause them to be damaged/deformed when suction is applied to them.

Besides, the tubular shape makes suction along the axial direction totally useless.

DISCLOSURE OF THE INVENTION

This invention therefore has for an aim to provide a device and a method for moving tubular bodies to overcome the disadvantages described above with reference to the prior art.

More specifically, the aim of this invention is to provide a device and a method for moving tubular bodies which allow the tubular bodies to be aligned efficiently and without damaging them.

These aims are achieved by a device for moving tubular bodies having the features of one or more of the appended claims from 1 to 13, as well as by a method for moving tubular bodies according to claims 14 and 15.

More specifically, the device for moving tubular bodies, comprises feeding means for feeding a plurality of tubular pieces, each extending along a respective axis of extension, where the feeding means are configured in such a way as to provide a succession of groups of tubular pieces where each group is defined by a predetermined number of tubular pieces positioned in succession along the respective axis of extension and transversely offset therefrom, and at least one offsetting means configured to translationally move the tubular pieces of each tubular element in such a way as to dealign the respective axes of extension.

According to one aspect of the invention, the translational transfer means is provided with at least one housing for containing at least one tubular piece placed therein and with blowing means operating inside the housing and configured to produce an air cushion by which the tubular piece is transferred translationally outside the housing along its respective axis of extension.

Advantageously, thanks to this solution, moving the tubular piece is immediate and non-invasive.

In particular, it should be noted that the term "air cushion" is used to mean that at least one surface for supporting the tubular body in the housing has a directed flow of air passing through it to eliminate friction and translationally move the tubular piece.

More precisely, in one preferred embodiment, the blowing means comprise at least one outlet opening associated with a side wall of the housing to produce an air flow which is transverse to the tubular piece (externally thereof), thus forming the air cushion.

Preferably, there are at least two outlet openings, located on opposite sides of the housing (and hence, of the tubular piece).

Advantageously, therefore, the tubular piece does not touch any surface during its axial movement and thus does not risk being damaged.

This is clearly a factor of critical importance in the sector in which the device according to this invention is applied.

In effect, the device is preferably mounted in a machine for making smokable articles, in particular in the unit for making the composite filters, or in a machine for making tubes to be used in later stages of the process when the tubular bodies are used and where preventing damage to the product is extremely important.

In this regard, the feeding means preferably comprise:

- supply means for delivering a plurality of elongate tubular elements extending along a respective main axis and each having a predetermined length "L";
- a cutting unit operatively located downstream of the supply means to receive the tubular elements in succession and configured to divide each tubular element into a plurality of tubular pieces of predetermined length "l" less than the predetermined length "L" of the tubular element and each extending along a respective axis of extension; and.
- an offsetting means configured to translationally transfer the tubular pieces of each tubular element in such a way as to dealign the respective axes of extension to make the groups of pieces.

BRIEF DESCRIPTION OF THE DRAWINGS

Further features and advantages of the invention are more apparent from the following exemplary and therefore non-limiting description of a preferred and hence non-exclusive embodiment of a device and a method for moving tubular bodies, as illustrated in the accompanying drawings, in which.

DETAILED DESCRIPTION OF PREFERRED EMBODIMENTS OF THE INVENTION

Figure 1:
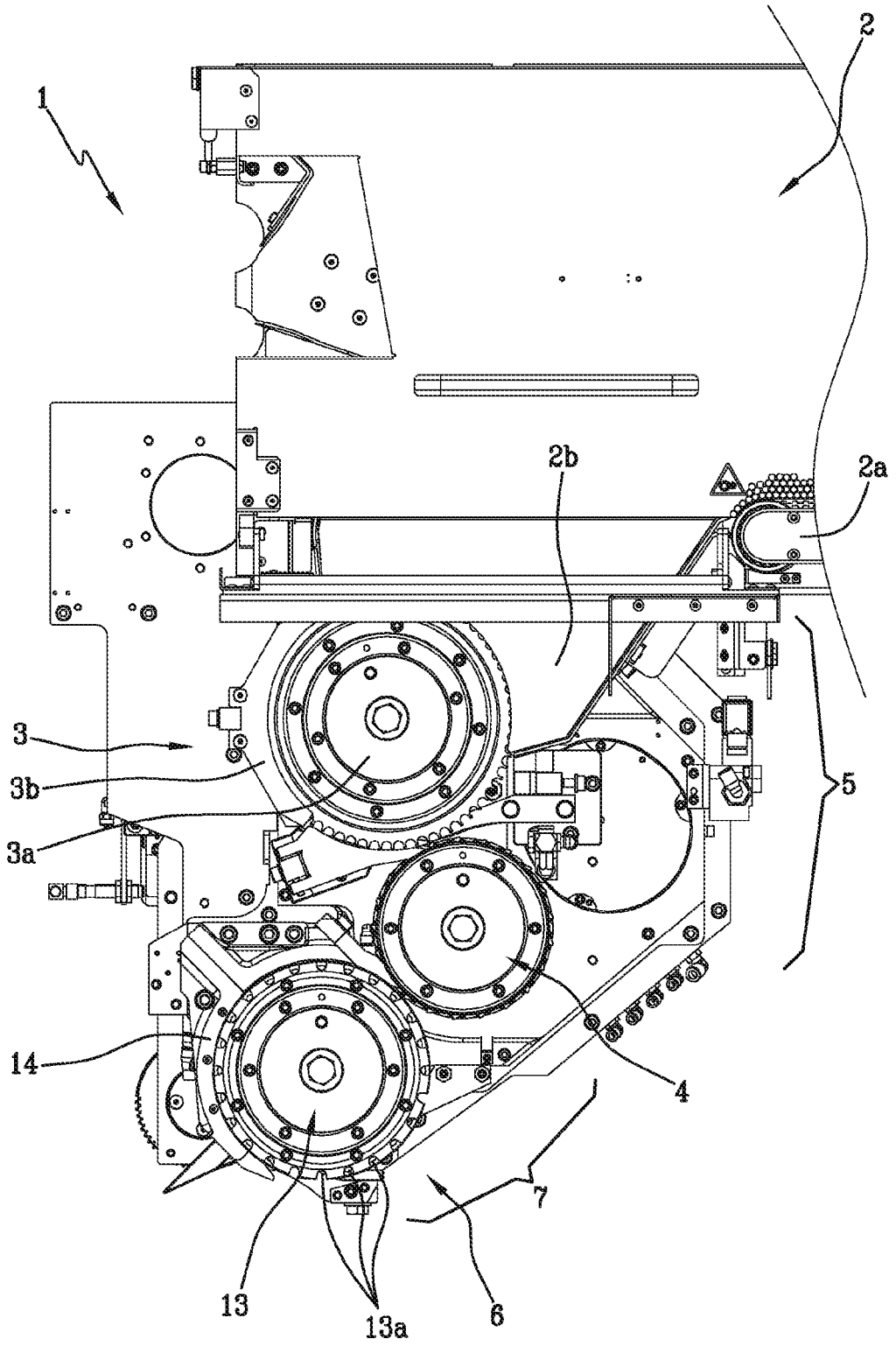
FIG. 1 shows a side view of a device for moving tubular bodies according to the invention.
Figure 2A:
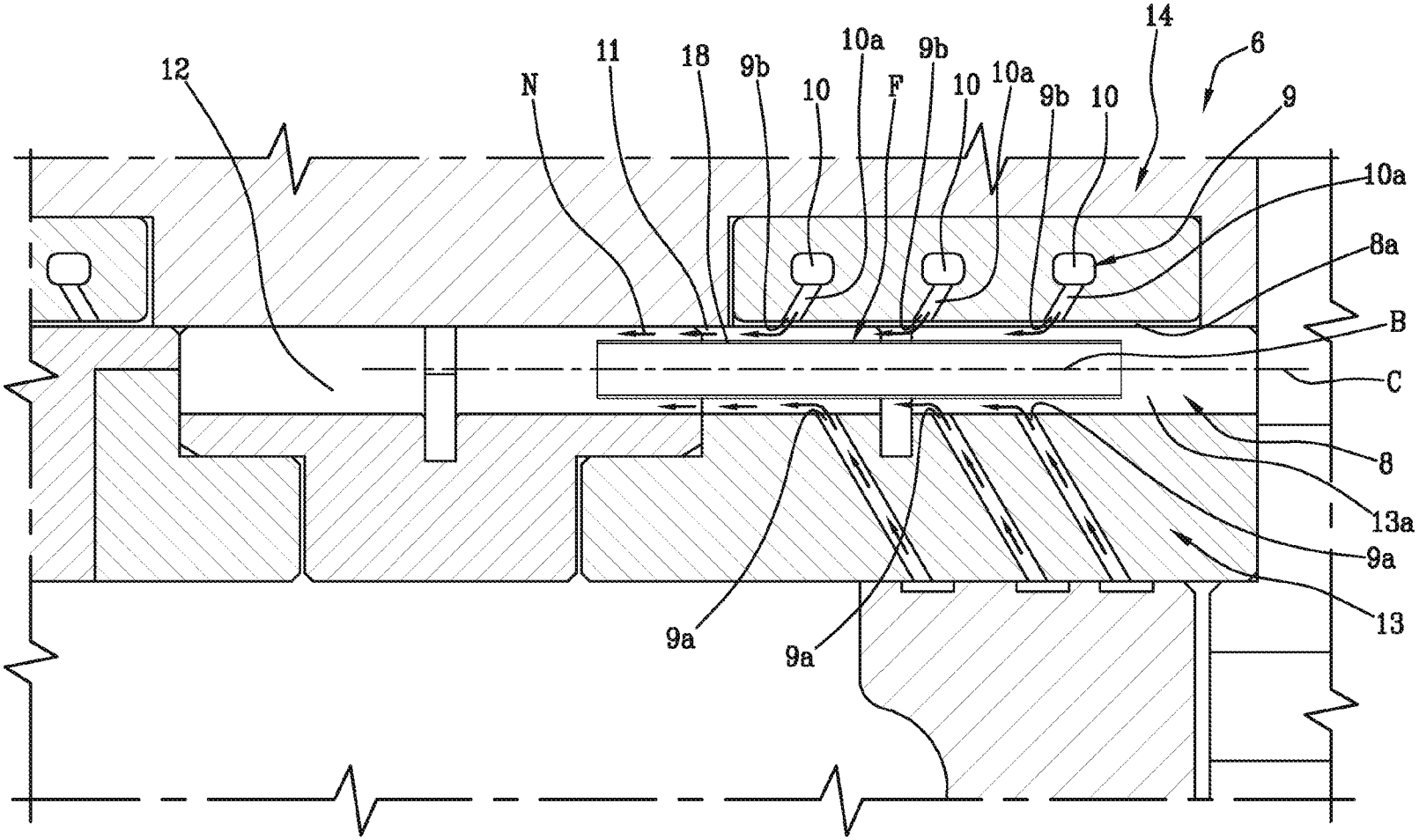
FIGS. 2*a*-2*c* are schematic cross section views of a detail of the device of FIG. 1 in three successive operating steps.
Figure 2B:
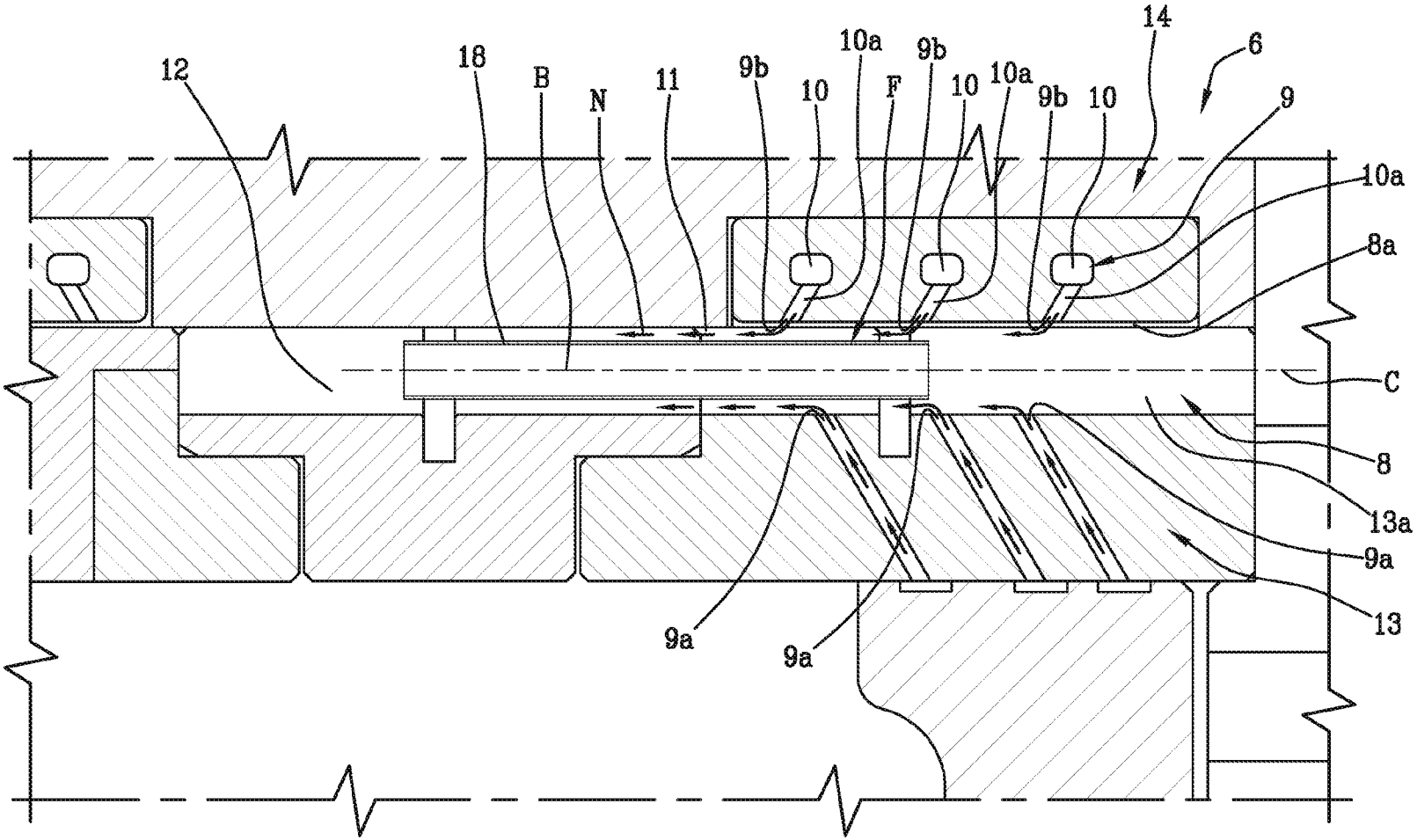
Figure 2C:
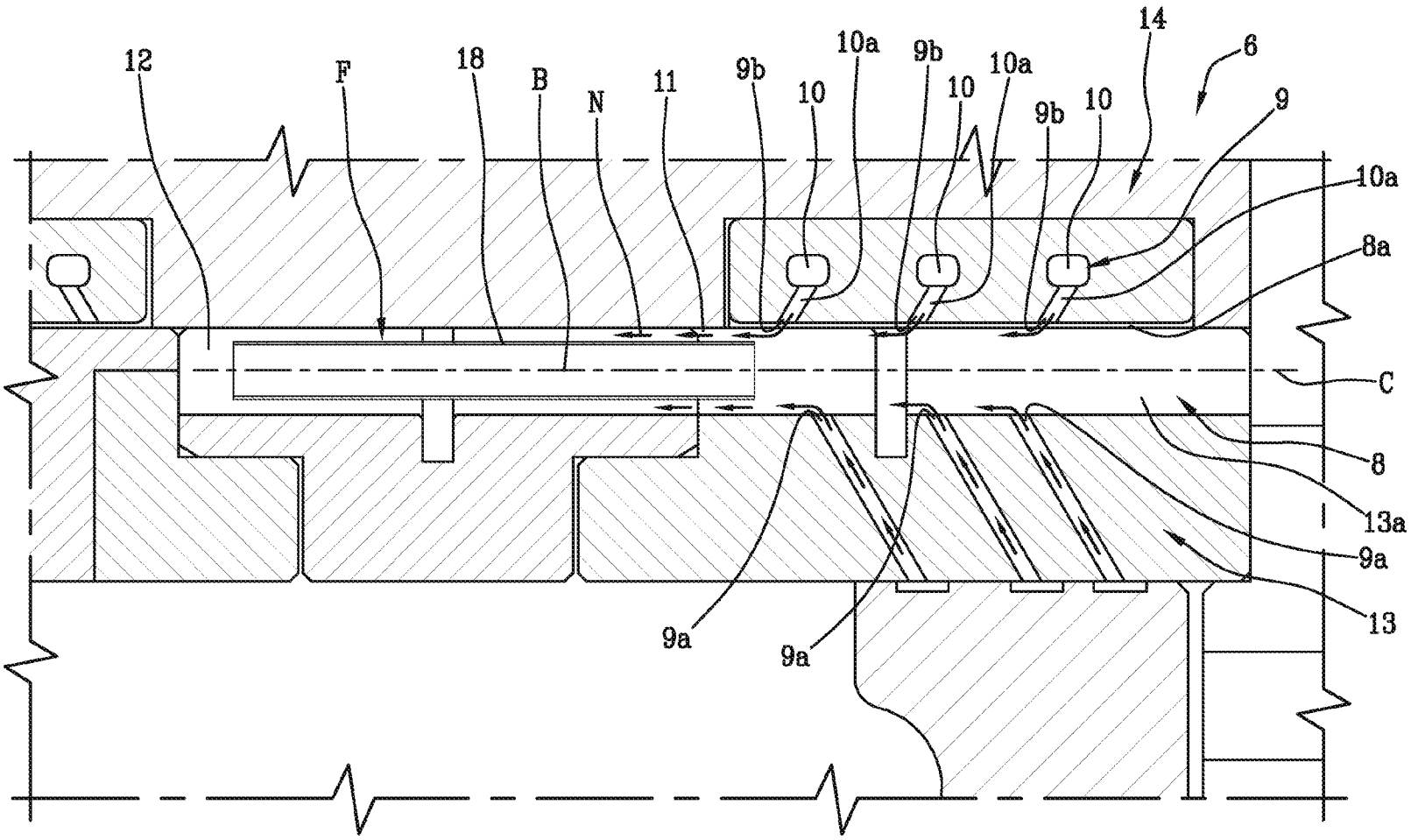

With reference to the accompanying drawings, the numeral 1 denotes a device for moving tubular bodies, made preferably of paper, paperboard, cardboard or plastic material.

Preferably, the tubular bodies define a portion of a composite filter for smokable articles, in particular cigarettes or cigarette holders.

Thus, the movement device 1 is preferably applicable in a machine for making smokable articles and in particular, in a unit, denoted by the numeral 100 in the accompanying drawings, for making filters, cigarette holders or composite filters.

The device 1 is thus used for moving tubular bodies, preferably made of paper, paperboard, cardboard or plastic material and having limited thickness and grammage (for example, 90-130 g, in particular 110 g).

The device 1 comprises supply means 2 for delivering a plurality of elongate tubular elements "T" extending along a respective main axis "A" and each having a predetermined length "L".

The tubular elements "T" have the same diameter as the bodies to be moved and, preferably, a length which is a multiple of the length of the bodies.

Preferably, the supply means 2 comprise a conveyor belt 2*a* and/or a hopper 2*b*.

In the embodiment illustrated, the conveyor belt 2*a* is movable along its operating direction in such a way as to move the tubular elements "T" transversely, that is, at right angles, to the respective main axis "A".

The hopper 2*b* is preferably located immediately downstream of the conveyor belt 2*a*, in particular, of a free end thereof, to receive the tubular elements "T" (by gravity).

The device 1 also comprises a cutting unit 3 operatively located downstream of the supply means 2 to receive the tubular elements "T" in succession.

The cutting unit 3 is configured to divide each tubular element "T" into a plurality of tubular pieces "F" of predetermined length "l" and each extending along a respective axis of extension "B" (parallel to the main axis "A").

The length "l" is smaller than the predetermined length "L" of the tubular element "T". More precisely, the length "l" of the tubular piece "F" is a submultiple of the length "L" of the tubular element "T".

The cutting unit 3 preferably comprises a drum 3*a* rotatable about a respective axis of rotation (parallel to the main axis "A" of the tubular elements "T") and provided with a plurality of peripheral grooves for receiving the tubular elements "T".

Also, cutting means 3*b* are provided to act on the periphery of the drum 3*a*, in particular at the grooves, to divide the tubular elements "T" into respective pluralities of pieces "F".

The cutting means 3*b* may be of a mechanical type (cutting blades or the like) or optical (e.g. laser cutters).

Preferably, therefore, the cutting unit 3 is configured to receive a sequence of tubular elements "T" and to deliver (after cutting) a sequence of groups of pieces "F", where each group is defined by a predetermined number of tubular pieces "F" (equal in number to the ratio between the length "L" and the length "l") aligned coaxially along the respective axes of extension "B".

In light of this, the device 1 also comprises at least one offsetting means 4 configured to translationally transfer the tubular pieces "F" made from each tubular element "T" in such a way as to dealign the respective axes of extension "B".

More precisely, the offsetting means 4 is configured to translationally move all, or some, of the pieces "F" of each group along a direction transverse, preferably at right angles, to the axis of extension "B".

In the preferred embodiment, the offsetting means 4 also comprises a rotary drum 4*a* operatively located downstream of the cutting unit 3 and preferably tangent to the drum 3*a* of the cutting unit 3.

The pieces are moved by means of flutes which are misaligned with each other (but fixed relative to one another) or using circumferentially movable grooves or pockets to dealign the pieces "F".

In other words, in the first embodiment, the offsetting means does not actively move the pieces "F" but "picks" them with a delay one from another in such a way as to dealign them.

Alternatively, in the second embodiment, the offsetting means 4 actively moves the pieces using specific movement means.

It should be noted that, preferably, all or some of the devices described up to now (supply means 2, cutting unit 3 and offsetting means 4) define feeding means 5 for feeding a plurality of the tubular pieces "F" and configured to provide a sequence of groups of tubular pieces "F" defined (that is, each group is defined) by a predetermined number of tubular pieces "F" positioned in succession along their axes of extension "B" and offset transversely to that direction of extension "B".

Operatively downstream of the offsetting unit 4, the device 1 comprises at least one translational transfer means 6 configured to move the pieces "F" along the respective axis of extension "B" to juxtapose them and define an ordered succession of pieces "F".

This ordered succession thus extends transversely, preferably at right angles, to the axes of extension of the pieces "F" themselves, which are placed in a substantially juxtaposed parallel relationship.

In light of this, the offsetting means 4 and the translational transfer means 6 jointly define an alignment unit 7 located operatively downstream of the cutting unit 3 and configured to translationally move the tubular pieces "F" from a first configuration, where the pieces "F" of each unit are aligned with each other along their axes of extension "B" to a second configuration, where the pieces "F" are juxtaposed with their axes of extension "B" substantially parallel.

According to one aspect of this invention, the translational transfer means 6 is provided with at least one housing 8 for containing at least one tubular piece "F" and with blowing means 9 operating inside the housing 8.

The blowing means 9 are configured to produce an air cushion by which the tubular piece "F" is transferred translationally outside the housing 8 along its respective axis of extension "B".

Advantageously, thanks to this solution, moving the tubular piece "F" is immediate and non-invasive.

In effect, that way, the tubular piece does not touch any surface during its axial movement and thus does not risk being damaged.

Preferably, the housing 8 extends along a central axis "C" corresponding to the axis of extension "B" of the respective tubular piece "F".

Further, the housing 8 is delimited by at least one side wall 8*a* placed radially to the central axis "C".

Thus, the side wall at least partly surrounds the central axis "C", preventing the pieces "F" in the housing 8 from moving transversely to the central axis "C" (or limiting such movement).

Also, to allow the piece "F" to come out, the housing 8 is provided with at least one opening 11. The opening 11 is thus located along the central axis "C".

In other words, the opening 11 is defined by a transverse cross section "C" and is located at one end of the housing 8.

In this regard, the translational transfer device 6 comprises at least one receiving zone 12, or receiving chamber 12, which can face the opening 11 to receive the tubular piece "F" translationally transferred by the blowing means 9.

Thus, the receiving chamber 12 is adjacent to the opening 11 and extends along the central axis "C" of the housing 8 (in practice defining an extension thereof).

Preferably, the blowing means 9 is connected to an air source and includes at least one outlet opening 9*a*, 9*b* associated with the side wall 8*a* to generate an air flow transverse to the tubular piece "F", thus defining the air cushion.

In particular, it should be noted that the blowing means 9, which (in an embodiment not illustrated) might also be a sequence of holes, are configured to blow from the at least one outlet opening 9*a*, 9*b* a flow of air "N" inclined relative to the central axis "C" of the housing 8 and having at least one component which is tangential to the central axis "C".

In other words, the air flow "N" (at least partly defining the air cushion) is directed in the same direction as the movement of the piece "F" and is inclined to the central axis "C".

The inclination is defined by angles β of between 5° and 75°, preferably between 15° and 45° and more preferably around 30°.

Structurally, the blowing means 9 have at least one duct 10 leading to the at least one outlet opening 9*a*, 9*b* and having an end stretch 10*a* that is inclined at a predetermined angle to the central axis "C" of the housing 8.

Preferably, the angle of inclination corresponds to (or coincides with) that of the air flow "N" (more precisely, determines it).

Thus, the end stretch 10*a* is inclined to the central axis "C" of the housing 8 at an angle α of between 5° and 75°, preferably between 15° and 45° and still more preferably, is approximately 30°.

In the preferred embodiment, the translational transfer means 6 comprises a rotary drum 13; the drum 13 is provided, on its periphery, with a plurality of angularly spaced flutes 13*a* for receiving at least one tubular piece "F" each.

It should be noted that the flutes run parallel to an axis of rotation of the drum 13.

The translational transfer means 6 also comprises at least one covering element 14 extending circumferentially at least partly around the drum 13 in such a way as to radially delimit each flute 13*a* it is facing.

Thus, in conjunction with the covering element 14, each flute 13*a* defines the at least one housing 8.

More precisely, the covering element 14 defines a portion of the side wall 8*a* of the housing 8 distal from the axis of rotation of the drum 13.

It should be noted that the drum 13 is rotatable, while the covering element 14 is fixed.

Thus, the housing is defined by a flute 13*a* and the respective portion of covering element 14 under which the flute 13*a* itself passes.

It should be noted that, preferably and according to the embodiment illustrated, the translation transfer means 6 comprises a plurality of housings 8 (angularly) spaced from each other and each defined by one flute 13*a* and by a respective portion (which varies during rotation) of the covering element 14.

In some embodiments, the rotary drum might be replaced with a translating element (for example a conveyor belt), in which case the flutes would be spaced only axially and not angularly.

Preferably, the blowing means 9 have at least one proximal outlet opening 9*a* which is proximal to the axis of rotation of the drum 13 and made at each flute 13*a*.

More precisely, the proximal outlet opening 9*a* is made on a base 15 which supports the piece "F" inside the flute 13*a*.

The proximal outlet opening 9*a* preferably possesses the features described above in connection with a generic "outlet opening".

Moreover, the blowing means 9 preferably have a plurality of proximal outlet openings 9*a* located in succession along the central axis "C" of the housing and spaced from each other.

In the preferred embodiment, the blowing means 9 have at least one distal outlet opening 9*b* which is distal from the axis of rotation of the drum 13 and made at the covering element 14.

The distal outlet opening 9*b*, too, preferably possesses the features described above in connection with a generic "outlet opening".

Figure 3:
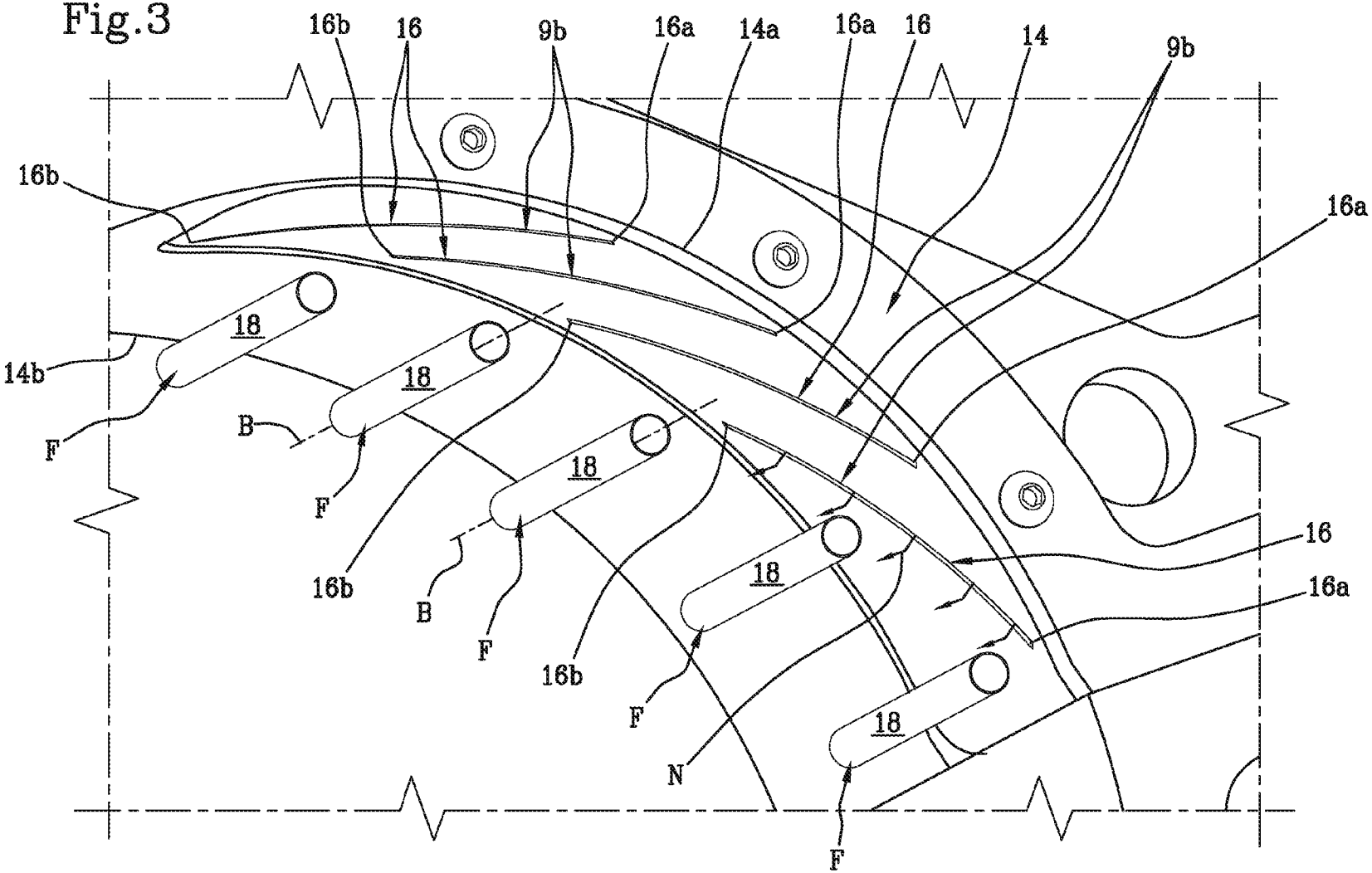
FIG. 3 is a perspective view of a portion of the device of FIG. 1 with some parts cut away to better illustrate others.
Figure 4:
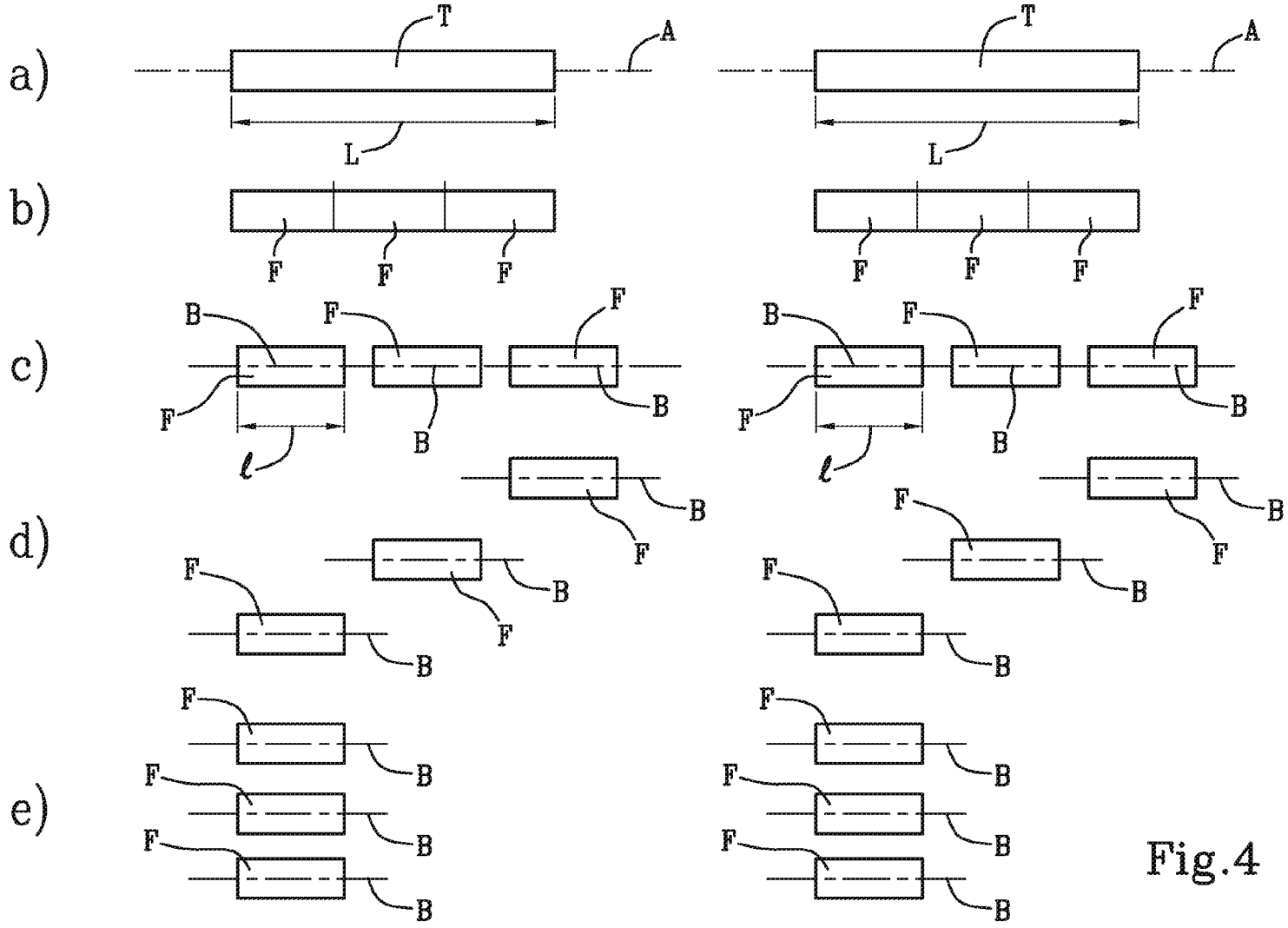
FIG. 4 schematically illustrates a sequence of steps of the method according to the invention.

Preferably, with reference for example to FIG. 3, the distal outlet opening 9*b* is elongate in shape and extends circumferentially around the drum 13.

In other words, the distal outlet opening 9*b* is defined by an elongate slot 16 running along the covering element 14 and at least partly surrounding the drum in such a way as to continue acting on the piece "F" while the drum 13 rotates.

In this regard, it should be noted that the covering element 14 extends between a first circumferential edge 14*a* and a second circumferential edge 14*b*; the distal outlet opening 9*b* (that is, the slot 16) in turn extends elongately between a first end 16*a*, proximal to the first edge 14*a*, and a second end 16*b*, proximal to the second edge 14*b*.

Thus, the distal outlet opening 9*b* extends in a direction inclined to a circumferential axis surrounding the drum 13.

Moreover, the blowing means 9 preferably have a plurality of distal outlet openings 9*b* located in succession along the central axis "C" of the housing and spaced from each other.

Advantageously, this guarantees uniform action for the full distance travelled by the tubular piece "F".

Also an object of this invention is the method for moving the tubular bodies (that is, tubular pieces) which is preferably but not exclusively implemented by the device of this invention.

The method comprises preparing at least one elongate tubular element "T" extending along a respective main axis "A" and having a predetermined length "L" and then dividing it into a plurality of coaxial tubular pieces "F" arranged in succession along the main axis "A".

Next, or at the same time, the tubular pieces "F" are offset by translationally transferring all or some of them along a direction transverse to the main axis "A".

Thus, the pieces "F" are moved from a first configuration, where they are aligned along the main axis "A", to a second, intermediate configuration, where they are still arranged in succession but where their respective axes "B" are dealigned.

In light of this, the method in effect comprises translationally transferring all or some of the tubular pieces "F" along the main axis "A" so as to juxtapose them to define an ordered succession of pieces "F" extending transversely (that as at right angles) to the main axis "A".

According to one aspect of the invention, the translational transfer step is performed by means of a blowing action on an outside face of a side wall of the tubular pieces "F" to produce an air cushion capable of translationally transferring them.

In particular, the blowing action is oriented, that is, directed, in such a way as to impart a movement to the pieces.

Preferably, therefore, the blowing action is performed by directing the air flow at an inclination at least partly concordant with a direction of translation of the tubular piece "F", thus making it possible to simultaneously produce the air cushion and the translational movement.

In other words, the blown air produces both a lifting and a forward pushing action.

The invention achieves the above mentioned aims and brings important advantages.

In effect, the pneumatic means, which are of a type already in existence and employed in similar machines and which are used to produce an air cushion on the piece, on the one hand allow rapid, precise movement of the piece and, on the other, are simple and inexpensive to make.

Moreover, the provision of distal outlet openings which are elongate in shape allows maximizing the forward pushing action applied to the tubular pieces and thus optimizes their movement.

The invention claimed is:

1. A device for moving tubular bodies, comprising:

a feeding device for feeding a plurality of tubular pieces, each extending along a respective axis of extension; the feeding device being configured in such a way as to provide a succession of groups of tubular pieces where each group is defined by a predetermined number of tubular pieces positioned in succession along the respective axis of extension, where the feeding device includes at least one offsetting device configured to translationally transfer the tubular pieces of each group of tubular pieces in such a way as to dealign the respective axes of extension transversely to each other by translationally moving at least some of the tubular pieces of each group along a direction perpendicular to the respective axis of extension, the at least one offsetting device comprising a first rotary drum;

at least one translational transfer device placed operatively downstream of the offsetting device and configured to move the tubular pieces of each group of tubular pieces along the respective axis of extension to juxtapose the tubular pieces and define an ordered succession of tubular pieces which extends transversely to the axis of extension of the tubular pieces;

wherein the translational transfer device comprises a second rotary drum including a periphery, and on the periphery, a plurality of angularly spaced flutes, with each of the flutes being configured to receive at least one of the tubular pieces, and wherein the second rotary drum includes at least one housing for containing a respective tubular piece of the group of tubular pieces and a blowing device, the blowing device including at least one outlet opening in a side wall of the housing and connectable with an air source to generate an air flow transverse to the tubular piece defining an air cushion by which the respective tubular piece is transferred translationally along the respective axis of extension of the respective tubular piece;

wherein the translational transfer device comprises at least one covering element extending circumferentially at least partly around the second rotary drum to radially delimit each of the flutes that the at least one covering element is facing; the each of the flutes, in conjunction with the at least one covering element, defining the at least one housing; and wherein, for each of the flutes, the at least one outlet opening includes an outlet opening positioned in a radially inwardly area of a wall of the flute to be connectable with the air source to generate the air flow transverse to the tubular piece to define the air cushion;

wherein the at least one outlet opening includes at least one distal outlet opening which is distal from an axis of rotation of the second rotary drum and made at the at least one covering element.

2. The device according to claim 1, wherein the at least one housing extends along a central axis corresponding to the axis of extension of the respective tubular piece.

3. The device according to claim 2, wherein the blowing device is configured to blow from the at least one outlet opening a flow of air inclined relative to the central axis of the at least one housing and having at least one component which is parallel to the central axis.

4. The device according to claim 3, wherein the blowing device includes at least one duct leading to the at least one outlet opening and having an end stretch which extends along a direction that is inclined relative to the central axis of the at least one housing.

5. The device according to claim 3, wherein an inclination of the air flow or of an end stretch relative to the central axis of the at least one housing is defined by an angle between 5° and 75°.

6. The device according to claim 1, wherein the housing includes at least one receiving zone for receiving the tubular piece translationally transferred by the blowing device.

7. The device according to claim 1, wherein the at least one outlet opening includes at least one proximal outlet opening which is proximal to an axis of rotation of the second rotary drum and made at each flute of the second rotary drum.

8. The device according to claim 1, wherein the at least one distal outlet opening is elongate in shape and extends circumferentially around the second rotary drum.

9. The device according to claim 8, wherein the at least one covering element extends between a first circumferential edge and a second circumferential edge, where the at least one distal outlet opening extends elongately between a first end, proximal to the first circumferential edge, and a second end, proximal to the second circumferential edge.

10. The device according to claim 1, wherein the at least one covering element includes a plurality of distal outlet openings which are spaced from each other and positioned in succession along a circumferential direction so as to guarantee a uniform action along an entire movement path of the tubular piece.

11. The device according to claim 1, wherein the feeding device, operatively upstream of the offsetting device, comprises:

a supply device for delivering a plurality of elongate tubular elements extending along a respective main axis and each having a predetermined length;

a cutting unit operatively located downstream of the supply device to receive the tubular elements in succession and configured to divide each tubular element into a plurality of tubular pieces of predetermined length less than the predetermined length of the tubular element and each extending along the respective axis of extension.

12. The device according to claim 1, wherein:

the at least one outlet opening includes at least one proximal outlet opening which is proximal to an axis of rotation of the second rotary drum and made at each flute of the second rotary drum;

the at least one distal outlet opening is elongate in shape and extends circumferentially around the second rotary drum; and the feeding device, operatively upstream of the offsetting device, comprises:

a supply device for delivering a plurality of elongate tubular elements extending along a respective main axis and each having a predetermined length;

a cutting unit operatively located downstream of the supply device to receive the tubular elements in succession and configured to divide each tubular element into a plurality of tubular pieces of predetermined length less than the predetermined length of the tubular element and each extending along the respective axis of extension.

* * * * *